US007637748B2

(12) United States Patent
Chung et al.

(10) Patent No.: US 7,637,748 B2
(45) Date of Patent: Dec. 29, 2009

(54) ELECTRONIC DEVICE AND CONNECTOR AND CARD INSERTION METHOD THEREOF

(75) Inventors: Ming-Hung Chung, Taipei (TW); Yu-Chen Lee, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 0 days.

(21) Appl. No.: 12/248,296

(22) Filed: Oct. 9, 2008

(65) Prior Publication Data

US 2009/0104793 A1 Apr. 23, 2009

(30) Foreign Application Priority Data

Oct. 22, 2007 (TW) ..... 96139453 A

(51) Int. Cl.
*H01R 12/00* (2006.01)

(52) U.S. Cl. ..... 439/59

(58) Field of Classification Search ..... 439/59, 439/157, 159

See application file for complete search history.

(56) References Cited

U.S. PATENT DOCUMENTS 4,898,540 A * 2/1990 Saito ..... 439/153
5,211,568 A * 5/1993 Yamada et al. ..... 439/157
5,226,833 A * 7/1993 Lwee ..... 439/326
5,302,133 A * 4/1994 Tondreault ..... 439/157
5,413,497 A * 5/1995 Lwee ..... 439/328
5,470,240 A * 11/1995 Suzuki ..... 439/157
5,470,242 A * 11/1995 Cheng et al. ..... 439/157
5,660,552 A * 8/1997 Suzuki et al. ..... 439/159
5,676,555 A * 10/1997 Yu et al. ..... 439/157
5,961,346 A 10/1999 Choy
5,982,627 A * 11/1999 Haughton et al. ..... 361/759
6,181,565 B1 * 1/2001 Schmitt et al. ..... 361/756
6,276,950 B1 * 8/2001 Yodogawa ..... 439/160
6,368,126 B1 * 4/2002 Lee ..... 439/160
6,390,837 B1 * 5/2002 Lee ..... 439/160
6,449,163 B1 9/2002 Stark et al.
6,702,598 B1 * 3/2004 Lo ..... 439/157
6,735,091 B2 5/2004 Megason et al.
6,768,651 B2 * 7/2004 Takahashi et al. ..... 361/801
6,881,089 B1 * 4/2005 Yang ..... 439/377
7,118,398 B2 * 10/2006 Leidy ..... 439/160
2006/0018086 A1 1/2006 Liu
2006/0228610 A1 10/2006 Shu et al.

* cited by examiner

*Primary Examiner*—T C Patel
*Assistant Examiner*—Vladimir Imas
(74) *Attorney, Agent, or Firm*—Quintero Law Office

(57) ABSTRACT

A connector is provided. The connector is for connecting an electronic card. The electronic card comprises a first card side and a second card side, a first notch formed on the first card side, and a second notch formed on the second card side. The connector comprises a body, a first fixer and a second fixer. The body comprises a first side, a second side and a slot. The first fixer is disposed on the first side, wherein the first fixer pivots between a first orientation and a second orientation, and the first fixer abuts the first notch when the first fixer is in the first orientation. The second fixer is disposed on the second side, wherein the second fixer abuts the second notch via elastic force.

11 Claims, 5 Drawing Sheets

ELECTRONIC DEVICE AND CONNECTOR AND CARD INSERTION METHOD THEREOF

CROSS REFERENCE TO RELATED APPLICATIONS

This Application claims priority of Taiwan Patent Application No. 96139453, filed on Oct. 22, 2007, the entirety of which is incorporated by reference herein.

BACKGROUND OF THE INVENTION

1. Field of the Invention

The present invention relates to a connector, and in particular relates to a connector connected to a memory card.

2. Description of the Related Art

A conventional connector has fixers pivotably disposed on two sides thereof. When a memory card is inserted into the connector, the fixers wedge the memory card. When a user wants to detach the memory card from the connector, the user pivots the fixers to release and push the memory card. For configurations within a conventional computer, elements overlap or interfere with each other. Therefore, when accessing the memory card, a CD-ROM device, DVD-ROM device, hard disc or bus wire may hinder the user from pushing the fixers and sufficiently fixing the memory card.

BRIEF SUMMARY OF THE INVENTION

A detailed description is given in the following embodiments with reference to the accompanying drawings.

A connector is provided. The connector is for connecting an electronic card. The electronic card comprises a first card side and a second card side, a first notch formed on the first card side, and a second notch formed on the second card side. The connector comprises a body, a first fixer and a second fixer. The body comprises a first side, a second side and a slot. The first fixer is disposed on the first side, wherein the first fixer pivots between a first orientation and a second orientation, and the first fixer abuts the first notch when the first fixer is in the first orientation. The second fixer is disposed on the second side, wherein the second fixer abuts the second notch via elastic force.

An electronic device is provided. The electronic device, comprising: an electronic card, comprising a first card side, a second card side, a first notch and a second notch, wherein the first notch is formed on the first card side, and the second notch is formed on the second card side; and a connector, connected to the electronic card, the connector comprising: a body, comprising a first side, a second side and a slot, wherein the electronic card is inserted in the slot; a first fixer, disposed on the first side, wherein the first fixer pivots between a first orientation and a second orientation, and the first fixer abuts the first notch when the first fixer is in the first orientation; and a second fixer, disposed on the second side, wherein the second fixer abuts the second notch via elastic force.

A method for accessing an electronic card is provided. The method comprising: inserting the electronic card into a slot of an electronic device, wherein a bottom side of the electronic card pushes an abutting portion of a second fixer to elastically deform an U-shaped portion of the second fixer for allowing the electronic card to be inserted thereinto, and an abutting portion of the second fixer abuts a second notch of the electronic card via elastic force when the electronic card is sufficiently inserted into the slot; and pivoting a first fixer from a second orientation to a first orientation to abut a first notch of the electronic card.

Utilizing the embodiment of the invention, because the second fixing element is an elastic sheet abutting the electronic card via elastic force, the user can fix and detach the electronic card easily and conveniently. Moreover, even when other elements obstruct the second fixer, the user still can detach the electronic card easily.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
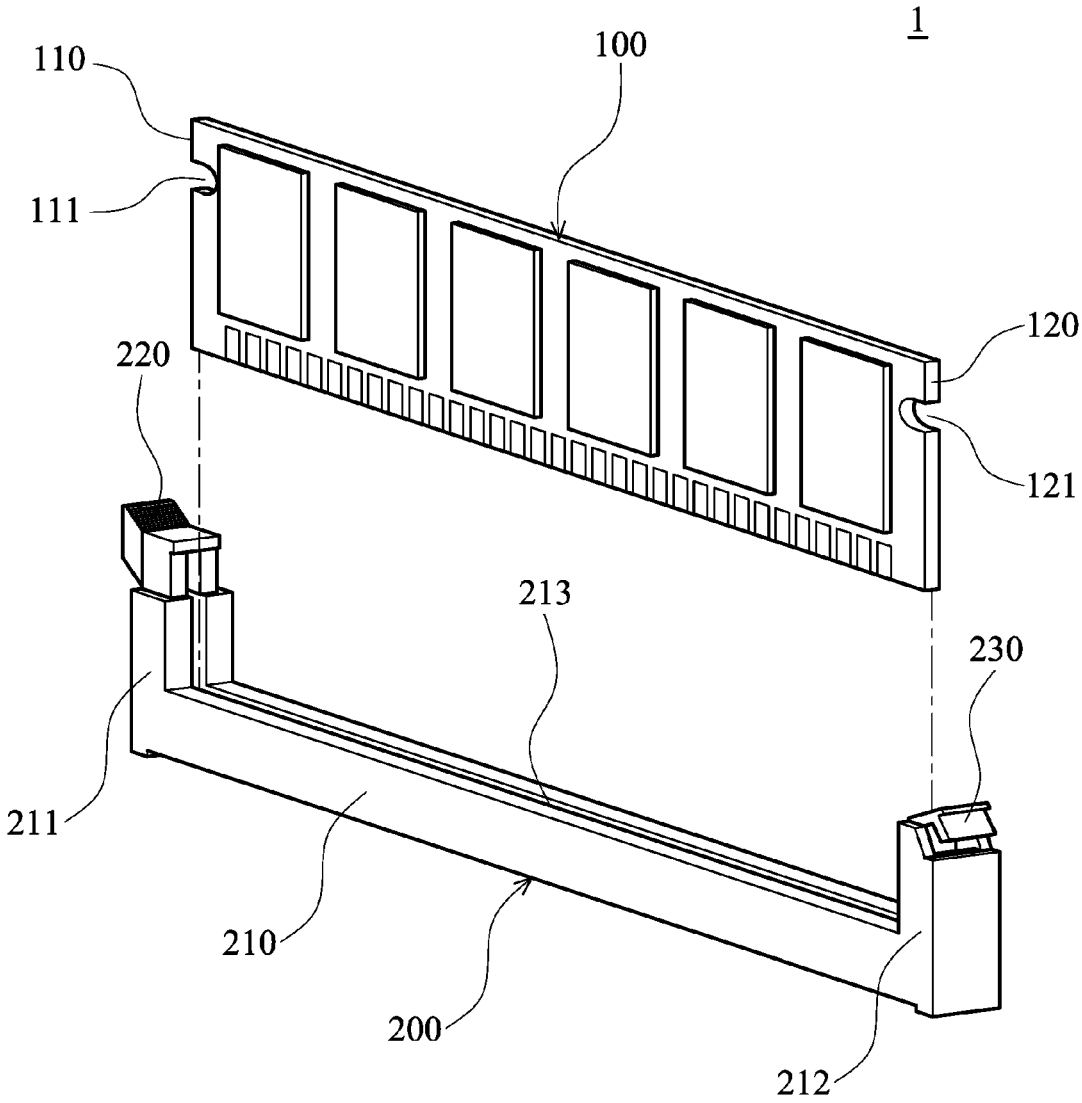
FIG. 1 shows an electronic device of an embodiment of the invention.

FIG. 1 shows an electronic device 1 of an embodiment of the invention, comprising an electronic card 100 and a connector 200.

The electronic card 100 comprises a first card side 110 and a second card side 120. A first notch 111 is formed on the first card side 110. A second notch 121 is formed on the second card side 120.

The connector 200 is connected to the electronic card 100. The connector 200 comprises a body 210, a first fixer 220 and a second fixer 230. The body 210 comprises a first side 211, a second side 212 and a slot 213. The electronic card 100 is inserted into the slot 213. The first fixer 220 is disposed on the first side 211. The first fixer 220 pivots between a first orientation and a second orientation. The second fixer 230 is disposed on the second side 212. The second fixer 230 abuts the second notch 121 via elastic force.

Figure 2A:
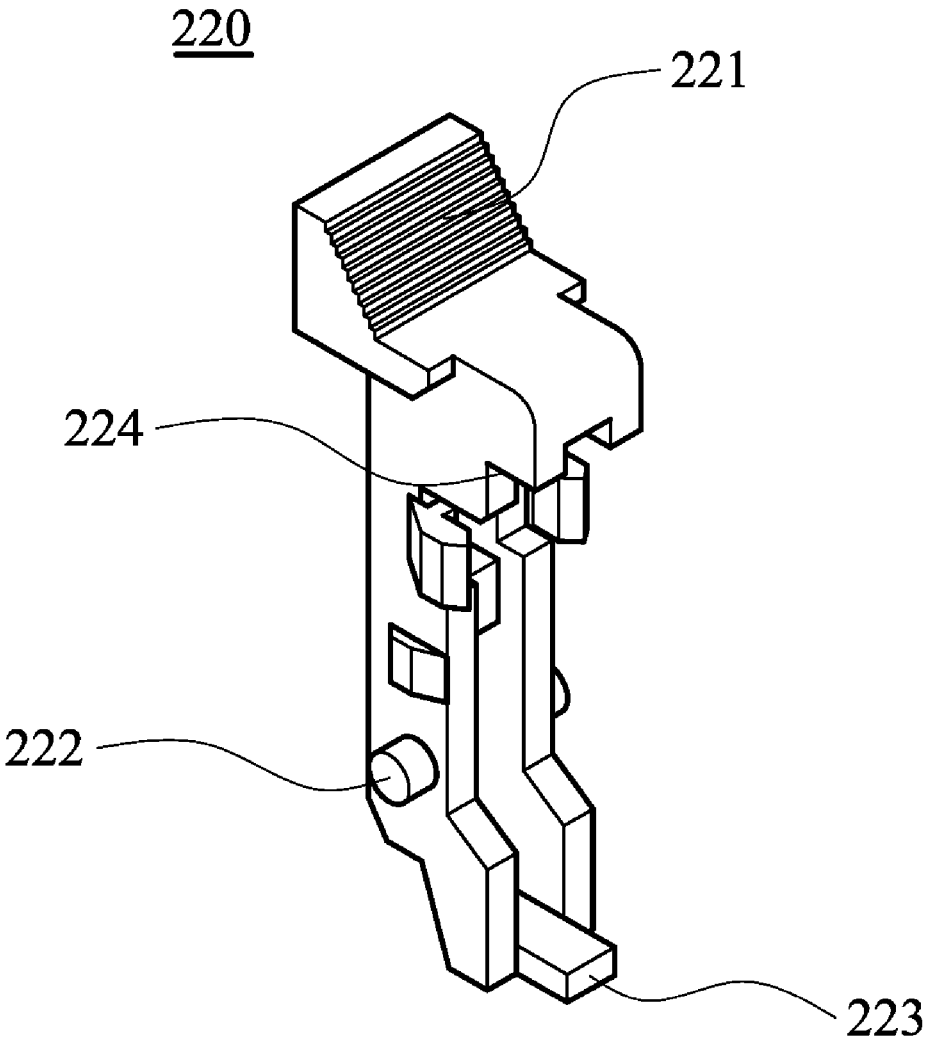
FIG. 2*a* shows a detailed structure of a first fixer.
Figure 2B:
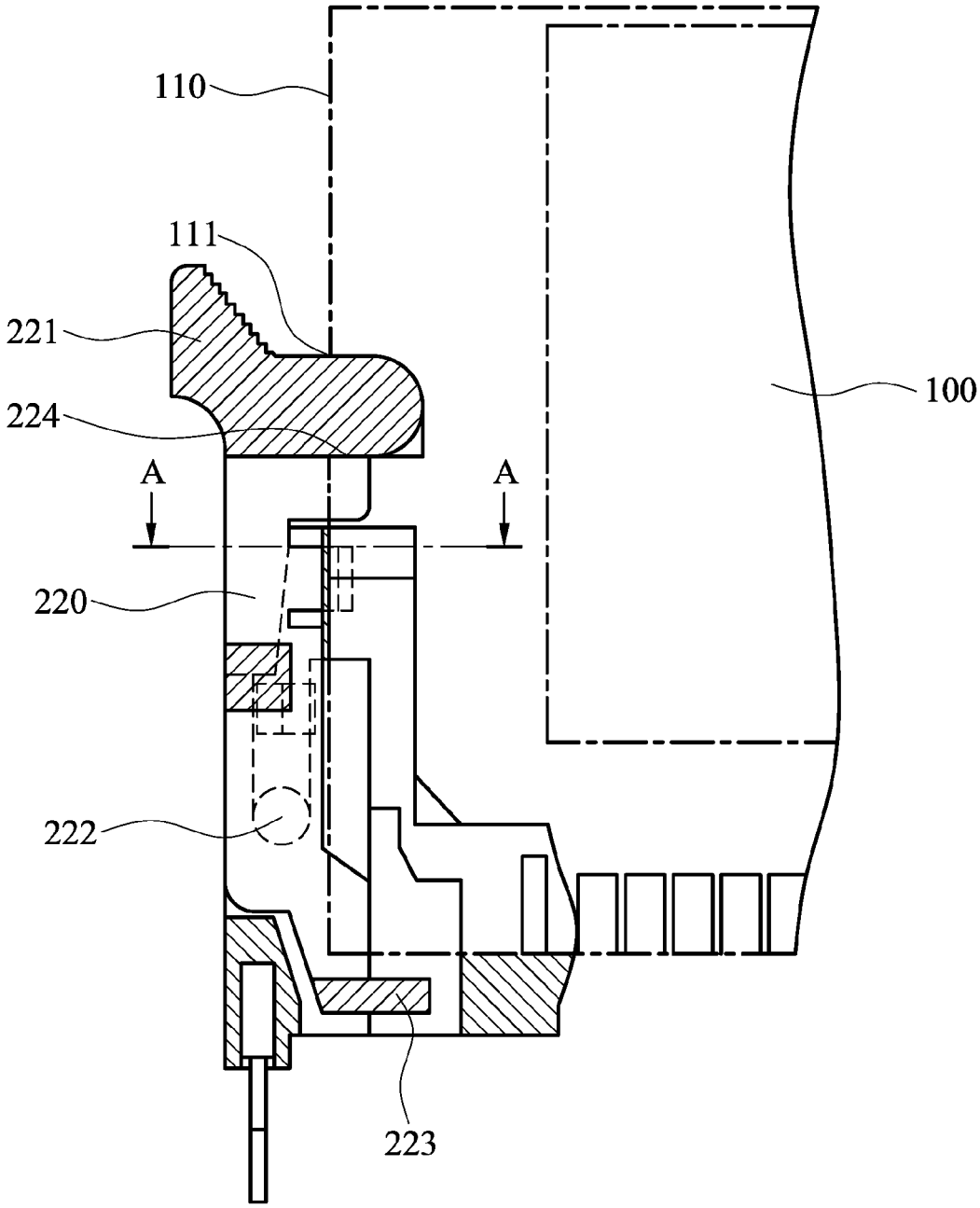
FIG. 2*b* shows the first fixer in a first orientation.
Figure 2C:
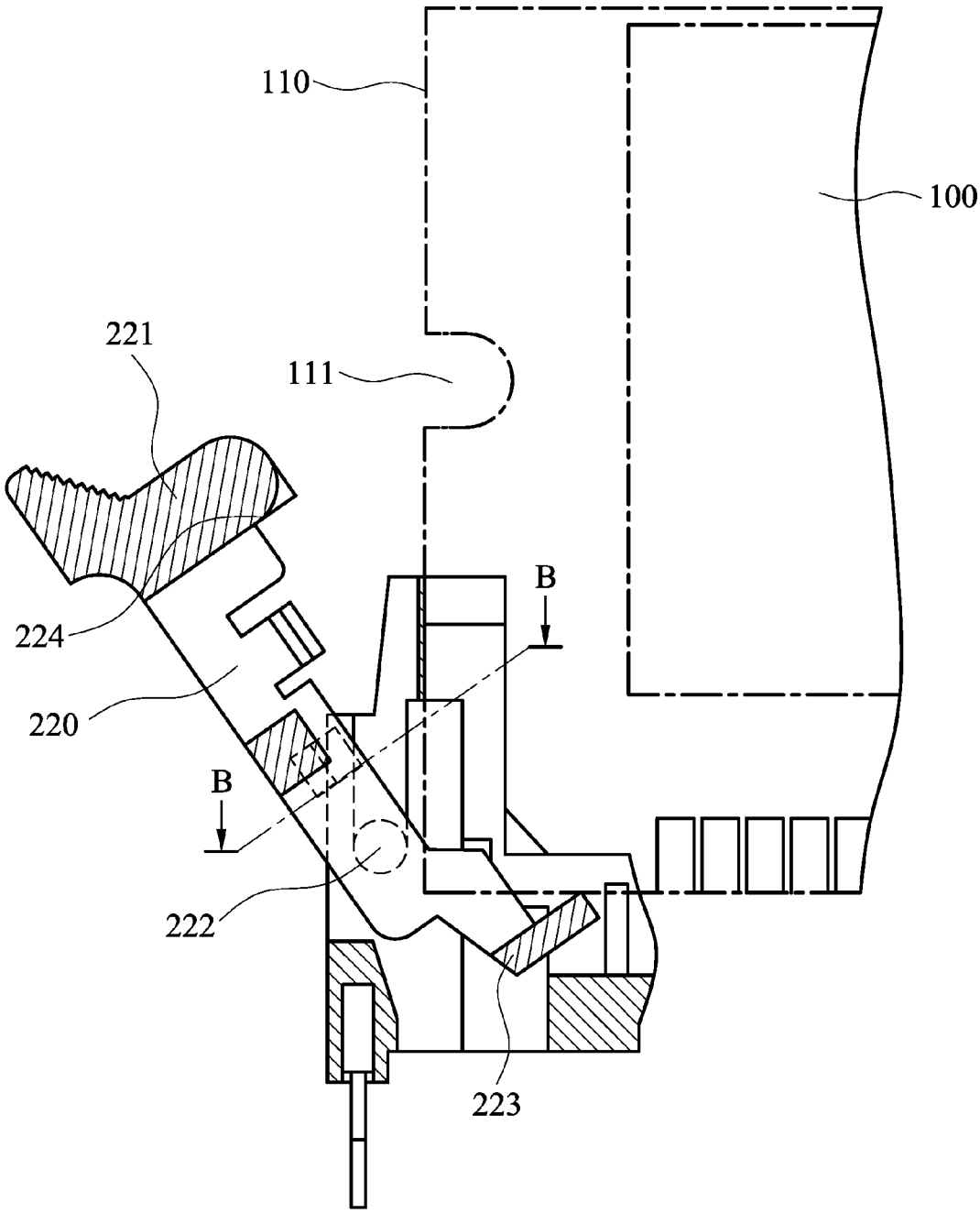
FIG. 2*c* shows the first fixer is a second orientation.

FIG. 2*a* shows a detailed structure of the first fixer 220. The first fixer 220 comprises a pressing portion 221, a shaft 222, a pushing portion 223 and an abutting portion 224. With reference to FIG. 2*b*, when the first fixer 220 is in the first orientation A, the abutting portion 224 of the first fixer 220 abuts the first notch 111. With reference to FIG. 2*c*, when the first fixer 220 is in the second orientation B, the abutting portion 224 of the first fixer 220 leaves the first notch 111 to release the electronic card 100, and the pushing portion 223 pushes the bottom of the electronic card 100 to move the electronic card 100 out of the slot 213.

Figure 3:
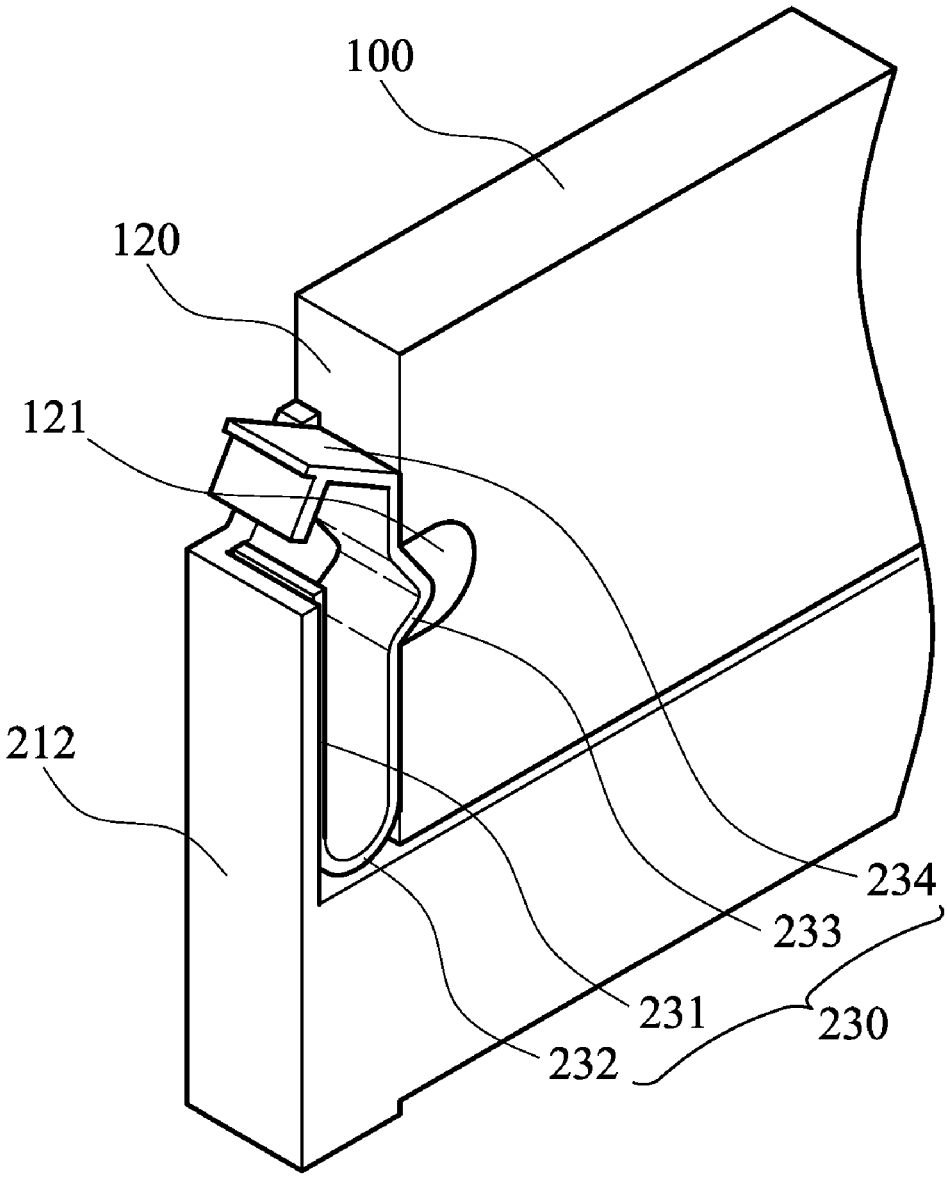
FIG. 3 shows a detailed structure of a second fixer.

FIG. 3 shows a detailed structure of the second fixer 230. The second fixer 230 is an elastic sheet embedded in an inner wall of the slot. The second fixer 230 comprises a fixing portion 231, a U-shaped portion 232, an abutting portion 233 and a pressing portion 234. The fixing portion 231 is connected to an end of the U-shaped portion 232, and the abutting portion 233 is connected to the other end of the U-shaped portion 232. The abutting portion 233 abuts the second notch 121. The fixing portion 231 is embedded in the inner wall of the slot. The pressing portion 234 is connected to the abutting portion 233. When user presses the pressing portion 234, the U-shaped portion 232 deforms to separate the abutting portion 233 from the second notch 121 to release the electronic card 100.

The process for accessing the electronic card 100 is disclosed as follows. When the electronic card 100 is inserted into the slot, the bottom side of the electronic card 100 pushes the abutting portion 233 to deform the U-shaped portion to allow the electronic card 100 to be inserted thereinto. When the electronic card 100 is sufficiently inserted, the U-shaped portion 232 pushes the abutting portion 233 into the second notch 121 by elastic force. Meanwhile, the first fixer 220 is rotated from the second orientation to the first orientation to abut the first notch.

When the user wants to detach the electronic card 100 from the slot 213, the first fixer 220 is rotated from the first orientation to the second orientation to separate the first fixer 220 from the first notch 111 to release the electronic card 100. The first fixer 220 pushes and tilts the electronic card 100. Then, the user pulls the electronic card 100 out of the slot 213. When the user is pulling the electronic card 100, the second notch 121 pushes the abutting portion 233 to deform the U-shaped portion 232 to allow the electronic card 100 to leave the slot 213.

When detaching the electronic card, if the electronic card is jammed, the user can press the pressing portion 234 to release the electronic card 100.

In the embodiments of the invention, the electronic card is a memory card, such as, a double data rate (DDR) memory card. Meanwhile, the electronic device is a desk-top computer.

Utilizing the embodiment of the invention, because the second fixing element is an elastic sheet abutting the electronic card via elastic force, the user can fix and detach the electronic card easily and conveniently. Moreover, even when other elements obstruct the second fixer, the user still can detach the electronic card easily.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A connector for connecting an electronic card, wherein the electronic card comprises a first card side and a second card side, a first notch formed on the first card side, and a second notch formed on the second card side, comprising:

a body, comprising a first side, a second side and a slot;

a first fixer, disposed on the first side, wherein the first fixer pivots between a first orientation and a second orientation, and the first fixer abuts the first notch when the first fixer is in the first orientation; and a second fixer, disposed on the second side, wherein the second fixer abuts the second notch via elastic force, the second fixer is an elastic sheet partially embedded in an inner wall of the slot, the second fixer comprises a fixing portion, a U-shaped portion and an abutting portion, the fixing portion is connected to an end of the U-shaped portion, the abutting portion is connected to the other end of the U-shaped portion, and the abutting portion abuts the second notch.

2. The connector as claimed in claim 1, wherein the fixing portion is embedded in the inner wall of the slot.

3. The connector as claimed in claim 1, wherein the second fixer further comprises a pressing portion, connected to the abutting portion, and the U-shaped portion is deformed and separating the abutting portion from the second notch for releasing the electronic card when the pressing portion is pressed.

4. The connector as claimed in claim 1, wherein when the first fixer is in the second orientation, the first fixer is separated from the first notch for releasing the electronic card.

5. An electronic device, comprising:

an electronic card, comprising a first card side, a second card side, a first notch and a second notch, wherein the first notch is formed on the first card side, and the second notch is formed on the second card side; and a connector, connected to the electronic card, the connector comprising:

a body, comprising a first side, a second side and a slot, wherein the electronic card is inserted in the slot;

a first fixer, disposed on the first side, wherein the first fixer pivots between a first orientation and a second orientation, and the first fixer abuts the first notch when the first fixer is in the first orientation; and a second fixer, disposed on the second side, wherein the second fixer abuts the second notch via elastic force, the second fixer is an elastic sheet partially embedded in an inner wall of the slot, the second fixer comprises a fixing portion, a U-shaped portion and an abutting portion, the fixing portion is connected to an end of the U-shaped portion, the abutting portion is connected to the other end of the U-shaped portion, and the abutting portion abuts the second notch.

6. The electronic device as claimed in claim 5, wherein the fixing portion is embedded in the inner wall of the slot.

7. The electronic device as claimed in claim 5, wherein the second fixer further comprises a pressing portion, connected to the abutting portion, and the U-shaped portion is deformed and separating the abutting portion from the second notch for releasing the electronic card when the pressing portion is pressed.

8. The electronic device as claimed in claim 5, wherein when the first fixer is in the second orientation, the first fixer is separated from the first notch for releasing the electronic card.

9. The electronic device as claimed in claim 5, wherein the electronic card is a memory card.

10. The electronic device as claimed in claim 9, wherein the electronic card is a double data rate (DDR) memory card.

11. The electronic device as claimed in claim 5, wherein the electronic device is a desk-top computer.

* * * * *